United States Patent [19]

Mangiapane

[11] Patent Number: 4,586,358

[45] Date of Patent: May 6, 1986

[54] METHOD AND APPARATUS FOR PRODUCING WOUND COILS

[76] Inventor: Philip Mangiapane, 1201 Roebuck Ct., West Palm Beach, Fla. 33401

[21] Appl. No.: 578,968

[22] Filed: Feb. 10, 1984

[51] Int. Cl.[4] ..... B21F 3/04

[52] U.S. Cl. ..... 72/142; 140/124

[58] Field of Search ..... 72/135, 137, 142, 145, 72/216, 217, 149, 371; 140/102, 102.5, 71 R, 124

[56] References Cited

U.S. PATENT DOCUMENTS

| | | | |
|---|---|---|---|
| 274,557 | 3/1883 | Brand | 140/102 |
| 276,763 | 5/1883 | Brock | 72/142 |
| 2,514,096 | 7/1950 | Scott | 72/142 |
| 2,697,470 | 12/1954 | Sampatacos et al. | 72/142 X |
| 4,008,594 | 2/1977 | Noyce | 72/142 |

FOREIGN PATENT DOCUMENTS

| | | | |
|---|---|---|---|
| 887999 | 12/1971 | Canada | 140/124 |
| 3035309 | 4/1981 | Fed. Rep. of Germany | 72/142 |

*Primary Examiner*—E. Michael Combs
*Attorney, Agent, or Firm*—Malin, Haley & McHale

[57] ABSTRACT

Disclosed is a machine and method for bending an elongate bar of metal or other appropriate material into a general "V-shape", the vertex of the "V" being a coiled spring. The machine for making the device has a motor driven, horizontally rotating spool with a spool arm to grip and bend the bar about a generally vertical axis. In manufacturing the V-shaped device, a central portion of the bar is placed against the spool so that the spool's arm can grip the bar for winding the bar about the spool. The bar is then bent an appropriate number of times around the spool to form the coiled spring portion, and thereafter the spool rotated backward a portion of a turn to loosen the coils about the spool. The device can then be removed from the machine and finished into any number of products. An example of use for such a V-shaped device is as an exerciser, exercising being performed by bending the V-arms together against the force of the coiled vertex.

2 Claims, 6 Drawing Figures

METHOD AND APPARATUS FOR PRODUCING WOUND COILS

Tortion springs have a wide variety of commercial and industrial applications. It is an object of this invention to provide a method and apparatus for bending a central portion of a straight bar into such a tortion spring or coil.

SUMMARY OF THE INVENTION

In accordance with this and other objects that shall become apparent hereinafter, there is provided a machine for forming an elongate bar of metal or other appropriate material into a general "V-shape", the vertex of the "V" being a coiled spring. The machine for making the device has a motor driven, horizontally rotating, spool with an arm to grip and bend the bar about a generally vertical axis. The machine also has a vertically disposed, rigidly fixed post which abuts a portion of the bar so as to prevent the bar as a whole from rotating with the spool. The machine has an appropriate gear train for translating a source of rotational energy into rotation of the spool about its vertical axis. In a preferred embodiment, the source of rotational energy is a motor, such as a conventional squirrel cage, and the gear train is provided with a gear box connected to the motor, the output of the gear box transmitted to the spool via sprocket wheels and a sprocket chain.

In manufacturing the device, a central portion of the bar is placed abuttingly against the spool so that the arm can grip the bar for winding the bar about the spool. The bar is then twisted about the spool an appropriate number of times to form the coiled spring from the central portion about the spool. Thereafter, the spool is rotated backwardly a portion of a turn to loosen the coils about the spool. The spool can then be removed from the spindle and the coiled bar about the spool removed from the spool. Thereafter, the V-shaped bar can be machined, finished, etc., to the desired final product. A preferred use for the bar after it has been formed into such a V-shaped member is as an exercise device for the extremeties of one's body. (e.g. between the hands, the knees, the ankles, etc.). The muscles of these extremeties can be worked by flexing together and apart the arms of the V-shaped member against the force of the coiled spring that forms the vertex of this V-shape.

The instant invention will be more fully understood from the following detailed description, it being understood, however, that the invention is capable of extended application, and is not confined to the precise disclosure. Changes and modifications may be made that do not affect the spirit of the invention, nor exceed the scope thereof, as expressed in the appended claims. Accordingly, the instant invention will now be described with reference to the accompanying drawings.

BRIEF DESCRIPTION OF THE DRAWINGS

FIG. 4 shows the bar in the unbent position of FIG. 2.

DETAILED DESCRIPTION OF THE INVENTION

Figure 1:
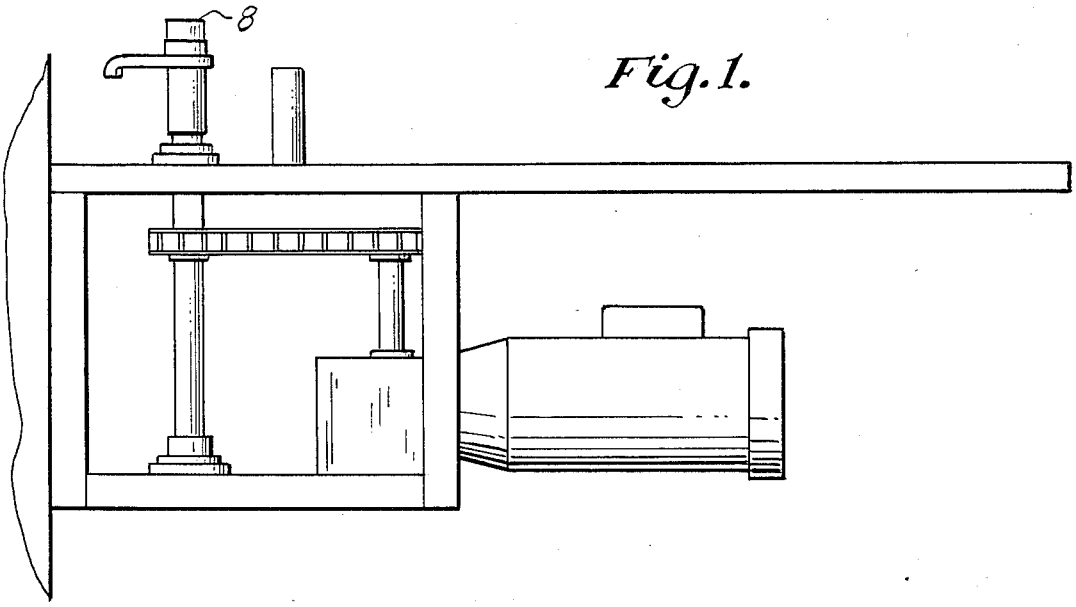
FIG. 1 is a side view of the machine of the instant invention.

With particular reference to the drawing figures, and initially special reference to FIG. 1, there is shown generally at 1 the apparatus of the instant invention. The ultimate source for power for the apparatus is motor 2. Motor 2 can be, for example, a conventional squirrel cage motor which drives gearbox 4, which itself has a rotational output at axle 5. The gearing structure of gear box 4 can be comprised of worm gears, or any other gearing scheme effective to produce the desired rotational output at 5. Axle 5 has about it sprocket wheel 6 that rotates sprocket chain 7. Sprocket chain 7 is also attached to sprocket wheel 6', which itself is fixedly attached to axle, or spindle, 5', which in turn rotates spool 8 about a vertical axis. Rotationally attached to spool 8 is an eccentric arm 9, having at its extremity a detent portion, or detent arm 10. The apparatus would be typically placed on a horizontally disposed platform 17. Numeral 18 in FIG. 1 indicates the level of the work surface used in conjunction with apparatus 1, which is better seen in FIG. 2.

Figure 2:
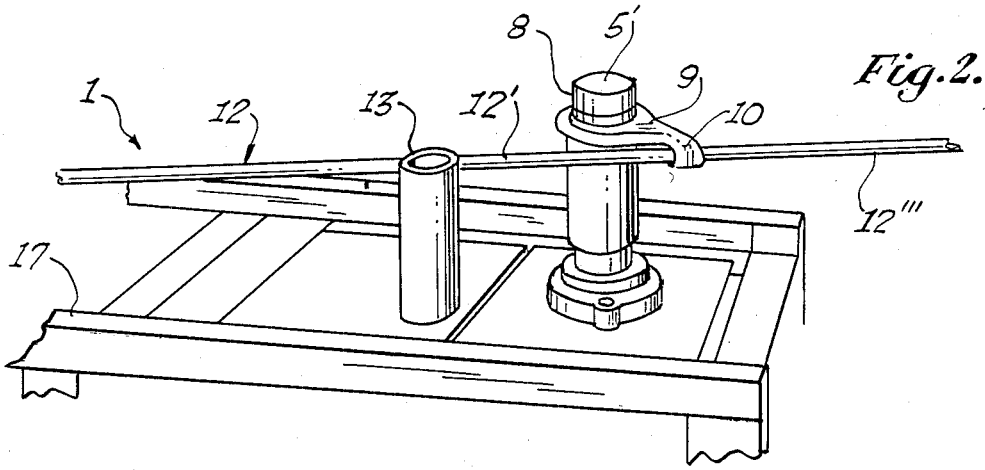
FIG. 2 is a similar view of the machine with a bar inserted into the machine in a position preferatory to bending of the bar.
Figure 3:
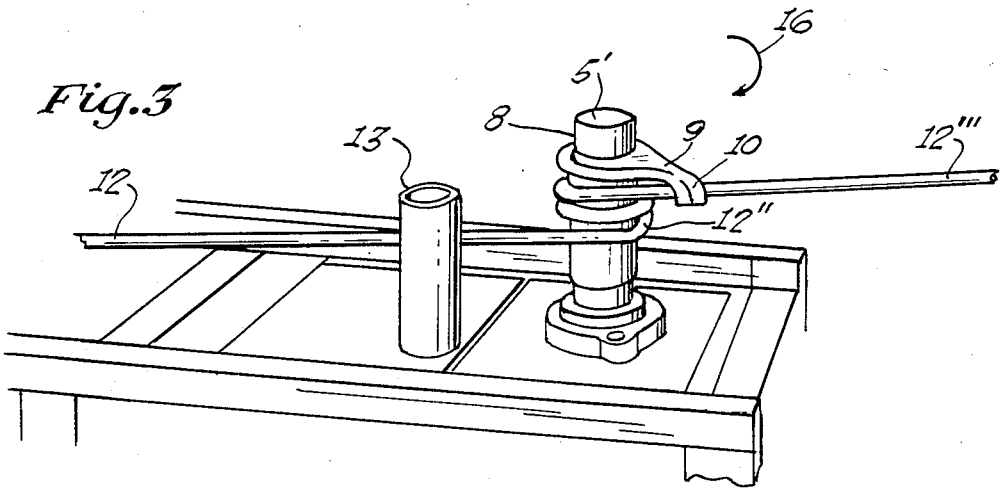
FIG. 3 is a view similar to FIGS. 1 and 2, but illustrating the bar, after it has undergone several turns.
Figure 4:
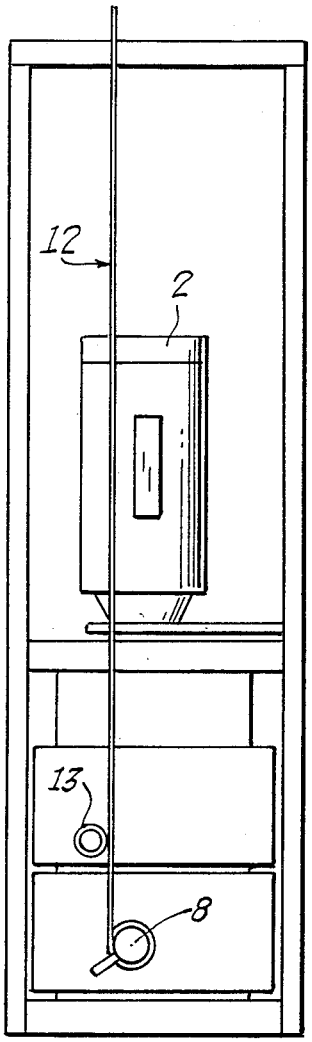
FIG. 4 is a top view of the machine showing only the spindle and spool, the detent post, and the bar.
Figure 5:
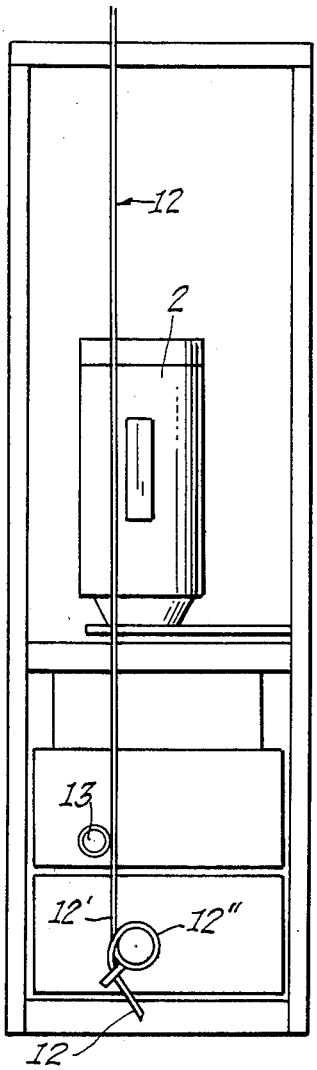
FIG. 5 is a view similar to FIG. 4, showing the bar bent as in FIG. 3.
Figure 6:
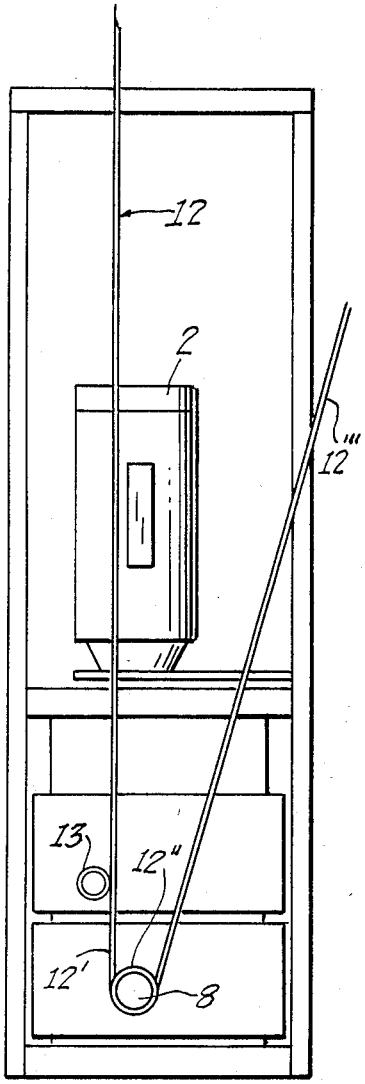
FIG. 6 is a view similar to FIGS. 4 and 5, showing the bar in its final position immediately before removal from the machine.

Work surface 11 has rigidly attached to it vertically disposed detent post 13. Work surface 11 is provided with a central opening (not shown) through which passes spindle 5' in a manner allowing 5' to turn freely. A bar 12, which is of metal or other appropriate material, is placed against detent post 13, against spool 8, and within spool arm 10. As best seen in FIG. 2, the vertical height of post 13 is less than that of spool 8, and bar 12 is placed in apparatus 1 at an acute angle to vertical. This ensures that, as arm 12''' is rotated in a generally horizontal plane, arm 12''' can pass freely over post 13. Rotation of spindle 5' and spool 8 causes arm 10 to twist bar 12 about spool 8, as best seen in FIG. 3. After spool 8 has rotated through several revolutions, bar 12 is seen to be now formed into three distinct portions, arms 12' and 12''', and central coil portion 12''. The operation of the apparatus is best seen in FIGS. 4 through 6. Straight bar 12 is bent in direction 15 a sufficient number of times to form the desired number of coils in portion 12'', at which time the direction of the gear train described above the reversed, causing spool 5' to move in reverse direction 16 a fraction of one turn. This reverse rotation causes the tension in the springs to loosen slightly so that the springs do not tightly grip spool 8. Spool 8 can now be removed from spindle 5', and the loosened spring coils at 12'' removed from the spool. The result is a V-shaped bar having V-arms 12', 12''' connected together at a central coil spring portion 12''.

As described above, arms 12', 12''' can be provided with appropriate hand grips or pads, and the V-shaped bar used, for example, as an exercising device.

The machine may be pre-programmed and operated automatically, may be operated manually, or by any desired combination of the two.

Although the invention has been described here by reference to vertical and horizontal directions, and for use as an exercise device, these are merely illustrative.

The instant invention has been shown and described herein in what is considered to be the most practical and preferred embodiment. It is recognized, however, that departures may be made therefrom within the scope of the invention, and that obvious modifications may occur to a person skilled in the art.

What is claimed is:

1. A machine effective to bend a straight bar into a V-shaped device, said device comprising a pair of V-arms joined together at a vertex, said vertex being a portion of said bar in the form of a coil spring, said machine comprising:

a work surface, a spool, said spool mounted on said work surface and disposed about a generally vertical axis, said spool being mounted for rotation about said generally vertical axis;

means for rotating said spool, a spool arm fixedly attached to said spool for rotation therewith and extending outwardly from said spool, said spool arm being positioned on said spool to abutt and twist a first portion of said bar about said spool responsive to said spool rotating about said vertical axis; and a generally vertically disposed detent post mounted on said work surface, said detent post and said spool located on said work surface and spaced with respect to one another a sufficient distance so that a second portion of said bar abutts said post as said first portion of said bar is rotated by said spool arm, the abutting of said second portion of said bar against said post being effective to prevent said second portion from rotating with said first portion as said first portion is rotated by said spool arm and helically coiled around said spool;

wherein the vertical height of said post is smaller than the vertical height of said spool arm to prevent said first portion of said bar from striking said second portion of said post as said first portion of said bar is coiled around said spool.

2. A method for bending a straight bar into a V-shaped device in a coil forming machine, said device comprising a pair of V-arms joined together at a vertex, said vertex being a portion of said bar in the form of a coiled spring, said coil forming machine comprising:

a work surface;

a spool, said spool mounted on said work surface and disposed about a generally vertical axis, said spool being mounted for rotation about said generally vertical axis;

a spool arm means for rotating said spool, attached to said spool for rotation therewith and extending outwardly from said spool, said spool arm being positioned on said spool to grip and twist a first portion of said bar about said spool responsive to said spool rotating about said vertical axis;

a generally vertically disposed detent post mounted on said surface, said detent post and said spool located on said work surface and spaced with respect to one another effective to permit a second portion of said bar to abutt said post as said first portion of said bar is rotated by said spool arm, the abutting of said second portion of said bar against said post being effective to prevent said second portion from rotating with said first portion as said first portion is rotated by said spool arm, wherein said method comprises the steps of:

placing said second portion of said bar abuttingly against said post, said bar being disposed by said placing of said second portion at an angle that is acute with respect to the vertical height of said post;

placing said first portion of said bar abuttingly against said spool;

placing said spool arm abuttingly against said first portion of said bar in a location effective to enable said spool arm to and twist said first portion of said bar as above recited;

said placing of said second portion of said bar against said post being selected so that said post prevents said second portion from rotating with said first portion, as above recited;

wherein said vertical height of said post and said acute angle are each selected to allow said spool arm to rotate with said first portion of said bar about said vertical axis through a generally horizontal angle of at least 360 degrees without said first portion of said bar striking said second portion or said port and, rotating said spool arm about said vertical axis and through said horizontal angle to helically coil said first portion of said bar around said spool and thereby form said V-shaped device.

* * * * *